United States Patent [19]

Mio

[11] 4,027,717

[45] June 7, 1977

[54] METHOD FOR FORMING A CASTING MOLD AND A FLEXIBLE PATTERN TO BE USED THEREFOR

[76] Inventor: Mitushi Mio, 4 - 2 Kamikamo, Sumoto, Hyogo, Japan

[22] Filed: Sept. 17, 1975

[21] Appl. No.: 614,155

[30] Foreign Application Priority Data

Oct. 7, 1974 Japan ..... 49-115761

[52] U.S. Cl. ..... 164/44; 164/222; 164/233; 164/249; 249/65; 249/183

[51] Int. Cl.[2] ..... B22C 9/00; B28B 7/32

[58] Field of Search ..... 164/44, 45, 13, 222, 164/233, 249, 170, 171, 180; 249/65, 183

[56] References Cited

UNITED STATES PATENTS

| | | | |
|---|---|---|---|
| 459,103 | 9/1891 | Adams | 164/222 |
| 2,170,188 | 8/1939 | Cobi | 249/65 |
| 2,324,554 | 7/1943 | Billner | 249/65 X |
| 3,074,140 | 1/1963 | Balcomb et al. | 249/183 X |

*Primary Examiner*—Leonidas Vlachos
*Attorney, Agent, or Firm*—Wenderoth, Lind & Ponack

[57] ABSTRACT

A method for forming casting molds, comprising forming a flexible pattern composed of rigid plates and a flexible cloth, the rigid plates being adhered to the flexible cloth with intervals between plates, and the flexible pattern being made an air-tight construction, pouring a fluid into the flexible pattern or supplying the fluid under pressure to form any desired shape thereof, discharging the fluid from the flexible pattern after a sand mold has been cured, and then withdrawing the flexible pattern from the sand mold.

13 Claims, 8 Drawing Figures

METHOD FOR FORMING A CASTING MOLD AND A FLEXIBLE PATTERN TO BE USED THEREFOR

BACKGROUND OF THE INVENTION

1. Field of the Invention

The present invention relates to a method for forming casting molds and more particularly to a method for forming casting molds for casting hollow metal castings, and further relates to a flexible pattern to be used therefor.

2. Description of the Prior Art

With the progress of casting techniques in recent years there have been published several techniques recently developed relating to methods for forming casting molds, for instance, a method for forming a foamed polystyreneseries vanishing type casting mold, in which the foamed polystyrene is to be destroyed by combustion. A further method for forming a casting mold includes coating a pattern with a thin plastic film at its surface, filling a flask with casting sand and coating the back surface of the flask with a plastic film, and also coated with a plastic film at its back surface, and then reducing the atmospheric pressures in the pattern as well as in the flask by means of a vacuum pump. The method of forming a foamed polystyrene series vanishing type mold has the advantage, as compared with conventional mold-forming methods, of not requiring such operations as the withdrawal of a pattern, but is attended with disadvantages that there is produced a large amount of gas due to the combustion of polystrene when molten metal is poured into the casting mold, and that the method itself is expensive, because the mold must be newly prepared for each casting. Therefore, countermeasures are required to avoid these disadvantages. The method of forming a casting mold, in which the pressures in the pattern and in the flask are reduced by means of a vacuum pump, has many advantages as compared with conventional casting molds, in that a bond is applied, but it is not free from the disadvantages that, when casting hollow metal castings, such operations as partitioning and reassembling the flask and the board are required, the precision of the measurements is required and further that high precision of measurements is required and that the problem of saving labour remains unsolved.

SUMMARY OF THE INVENTION

The purpose of the present invention is to solve the above-mentioned problems by providing a novel method for forming a casting mold by preparing a pattern of a novel construction, whereby it is made possible to save labour normally required to form a casting mold and to produce a casting mold having excellent properties.

The main object of the present invention is to provide a simple and easy method for forming a casting mold, in which such operations as the partition and reassembly of a sand mold are not required.

Another object of the present invention is to provide a method for forming a casting mold by preparing a flexible pattern of an air-tight construction, in which the partition and reassembly of a sand mold are not required.

BRIEF DESCRIPTION OF THE DRAWINGS

Still other objects of the present invention shall be apparent from the following description of the invention with reference to examples and the accompanying drawings.

FIGS. 1 to 4 illustrate a typical example of the present invention, wherein FIG. 1 is a plan view of the principal part of the mold of the present invention, FIG. 2 a base view of the principal part, FIG. 3 a cope in the state of being separated from a master mold and FIG. 4 a longitudinal section of the principal part.

FIGS. 5 to 8 illustrate another example of the present invention, wherein

FIG. 5 is a plan view of the principal part of the mold of the present invention, FIG. 6 a cope in the state of being separated from a master mold, FIG. 7 a longitudinal section of the principal part and FIG. 8 a detailed drawing of a part of FIG. 5.

DETAILED DESCRIPTION OF THE INVENTION

Figure 1:
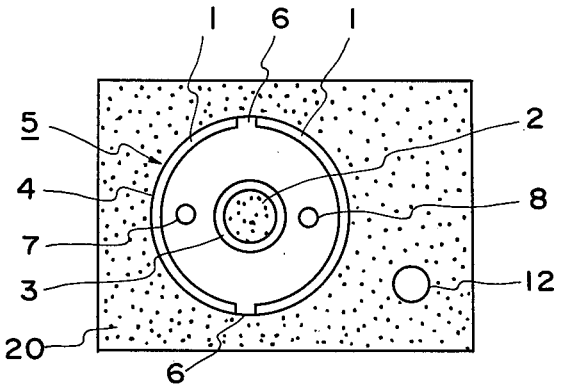
Figure 2:
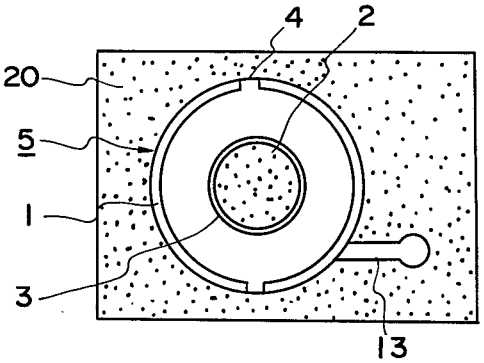

In order to achieve the objects above mentioned the present invention provides a novel method for forming a casting mold, which is characterized by preparing a flexible pattern composed of plates made of a rigid body and a flexible cloth, the flexible pattern being made an air-tight construction, then pouring a fluid under pressure into the flexible pattern to form any desired shape thereof; and thereafter reducing the size of and withdrawing the pattern from a sand mold by discharging the fluid from the the flexible pattern after the sand mold has been cured.

Further, the present invention provides a novel method for forming a casting mold, which is characterized by preparing a flexible pattern, which is made an air-tight construction by attaching several plates made of a rigid body to a flexible cloth, so that the pouring of a fluid or supplying of the fluid under pressure thereinto and the discharging of the fluid therefrom and the reduction of an atmospheric pressure therein are made possible, while forming a core mold within the flexible pattern, the core mold being constructed by the above-mentioned plate and being fixed to a mold drag.

In more detail, the present invention provides a novel method for forming a casting mold, comprising preparing a flexible pattern by arranging several thin and rigid plates, made according to the measurements of a desired original pattern layout, to a flexible cloth to form an outer part of the flexible pattern, the thin plates being adhered to the flexible cloth with intervals between the plates themselves, while preparing separately a core mold made from the a rigid plate or plates according to the measurements of a desired original pattern layout, the core mold being placed within the above-mentioned outer part of the flexible pattern and being connected with the outer part of the flexible pattern by the flexible cloth, to form an air-tight construction as one body, then pouring a fluid into the flexible pattern or supplying fluid under pressure to obtain a desired shape of the pattern, thereafter discharging the fluid from the flexible pattern after a sand mold has hardened and then withdrawing the flexible pattern from the sand mold.

As above mentioned, the mold pattern of the present invention is made an air-tight construction by attaching plates of rigid body to a flexible cloth. Therefore, a desired shape of the pattern can be obtained by pouring a fluid into the pattern or supplying the fluid under pressure, while connecting the pattern with a source of the fluid. Further, as the pattern of the present invention is made a flexible construction, the pattern can be withdrawn from the sand mold without the need of partitioning and reassembling the sand mold. Therefore, the present invention has succeeded in forming a casting mold in a very simple and easy manner.

The plates to be used in the present invention can be formed of various materials, for instance, timber, metals, plastics, particularly fibre-reinforced plastics (FRP). In the case of using a steel plate it may be as thin as about 1 mm, and in the case of using a wooden plate the thickness thereof may be 10 to 50 mm, preferably about 25 mm. As for the flexible cloth, the following materials are preferably used: rubber canvas, plastic cloth, fiber webs and webs soaked with plastics or rubbers. These materials should be flexible, but not expansible, because, if they are expansible, the shape of the flexible pattern of the present invention can not be maintained. The fluid material to be used in the present invention may be a gaseous body, a liquid body or a powdered body. In the case of filling the interior of the pattern with a gaseous body or a powdered body, some air draft is allowable, whereas in the case of filling with a liquid body a perfectly sealed construction is, of course, required.

In the following the present invention shall be explained in detail with reference to the drawings. FIGS. 1 to 4 relate to the formation of a casting mold of a cylindrical hollow body. Several pieces of thin plates of a rigid body 1, such as metal plates, which are to form an outer part of the pattern, and an inner thin plate 3, which is to form a core mould 2, are subjected to a press working operation or a sheet metal processing operation to form them each into a cylindrical form, faithfully according to the original or predetermined pattern layout or design. The outer thin plates 1 are then wrapped by a flexible cloth 4, for instance, a rubber canvas, whereby a flexible pattern 5 of an air-tight construction is formed together with the inner thin plate 3. FIGS. 1–4 show a construction including two outer thin plates 1 with intervals therebetween, but the present invention is not limited thereto. However, for drawing-out or removing the flexible pattern from the sand mold after the latter has hardened it is very effective to arrange the thin plates with intervals therebetween. Further, the upper and lower end surfaces of the flexible pattern 5 are covered with flexible clothes 4–1 and 4–2, which are further adhered to the core mold, so as to form a sealed construction. The flexible pattern is then provided with a hole 7 for pouring fluid into the pattern or for supplying fluid therein under pressure. The hole 7 is connected with a fluid source through a fluid pipe, not illustrated. Further, the flexible pattern 5 is provided with a hole 8 for exhausting gas, liquid or powder, if necessary.

Figure 3:
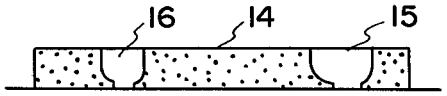
Figure 4:
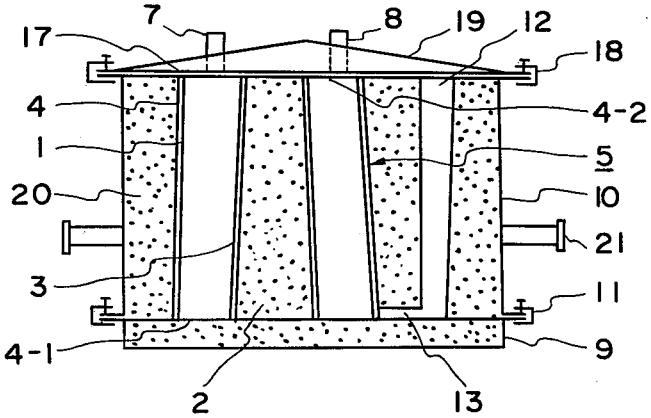
Figure 5:
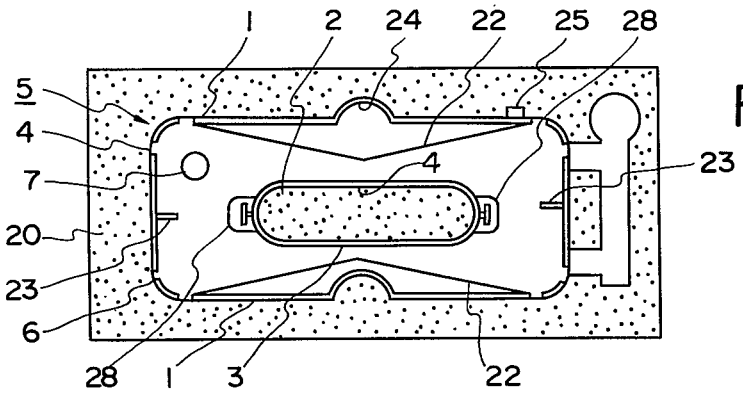
Figure 6:
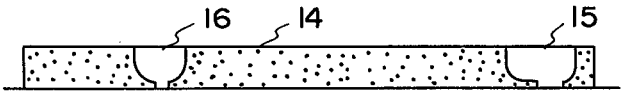
Figure 7:
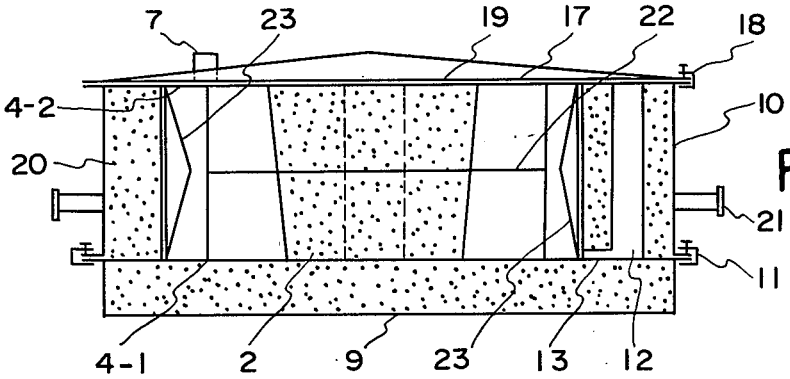
Figure 8:
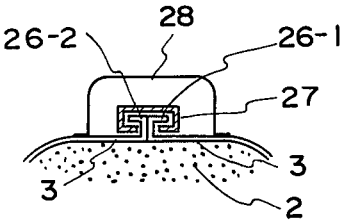

A mold drag 9 is tightly clamped with a master mold 10 by means of a mold clamping device 11. A sprue 12 of the master mold 10 is connected with the lower part of the flexible pattern 5 through a runner gate 13. A cope 14 is provided with a known pouring basin 15 and a feeder head 16. FIG. 3 shows the cope 14 separated from the master mold 10. It is suitable for a practical operation to supply a fluid into the flexible pattern under pressure, while applying an inner pressure of 0.02 to 4 atm gage, depending on the construction of the flexible pattern. Further, it is favorable for regulating the curing velocity of a self-hardening sand to pour the fluid or to supply the fluid under pressure, while keeping the temperature of the fluid at 30° to 70° C. In order to prevent the upper end surface of the flexible cloth 4–2 from being swollen due to the inner pressure it is recommended to hold down the flexible cloth 4–2 by a lid plate 17. As occasion demands, the lid plate 17 is provided with a reinforcement rib 19, which is clamped to the former by a clamping device 18. When a self-hardening sand 20 of the sand mold becomes viscous, or partly hardened the flexible pattern 5 is drawn out from the sand mold. For this purpose the inner pressure of the flexible pattern 5 is first reduced through the hole 7, whereby the outer thin plates 1 are separated from the sand mold due to the centripetal movement thereof and there is formed a gap therebetween. According to the result of experiments made by the inventor of the present invention the flexible pattern 5 can be easily drawn out from the sand mold in the contracted state due to a pattern draft gradient of its inner surface side without the need of separating the drag 9 from the master mold 10 by unfastening the clamping device 11. The term "partitioning of a sand mold" as employed herein means the separation of the drag 9 from the master mold 10 by unfastening the clamping device 11. That the present invention need not partition the sand mold is the most important advantage of the present invention, which is decisive for rationalizing the operation of forming a casting mold.

The flexible pattern 5 is required to be of an airtight construction as above mentioned, but the present invention is not limited to the specific structure described above. A construction of the flexible pattern 5 such as, for instance, rubber tube embedded in the interior space of the to-be-formed mold to provide for the application and reduction of the inner pressure therethrough, is, of course, included in the present invention.

In case the sand mold is required to be of refractory material, a mold wash must be applied on the surface of the sand mold. In such case, the mold wash is poured into the space within the molded sand, that is, the space for a cast body to be formed after the flexible pattern 5 is removed from the sand mold. After this space is filled with the mold wash, any excessive mold wash is discharged by turning over the sand mold by means of a supporting rod 21 of the master mold 10 so as to obtain a desired thickness of the mold wash. This refractory mold wash need not necessarily be dried, but rather it is sufficient to set fire thereto, if it has no water content and if it is self-hardening.

Further, as occasion demands, a mold wash slurry may be applied previously to the flexible pattern prior to the molding of the sand mold and thereby may be transferred to the sand mold. When the mold wash layer is firmly formed, the cope 14, which has been separately or simultaneously formed, is fixed and clamped to the master mold 10. In this way the preparation for pouring molten metal is completed.

FIGS. 5 to 8 illustrate another example of the present invention, relating to the formation of a casting mold having a rectangular form. FIGS. 5–8 employ the same reference numbers used in FIGS. 1 to 4. A flexible pattern 5 is formed by attaching outer thin plates 1 and an inner thin plate 3, which constitutes a core mold 2, to flexible clothes 4, according to the desired original pattern layout or design. The core mold in this example has a gradient tapering upwardly and outwardly. So as to make the drawing-out or removal of the flexible pattern easy the core mold is bent at its end parts to form bent parts 26–1 and 26–2 by subjecting the same to a bending operation. A cover chuck 27 of the same shape as the bent parts is slidingly placed thereover a vertical direction. Further, the whole length of the cover chuck 27 is air-tightly sealed by a protecting flexible cloth 28 so as to maintain the air-tight construction, while reproducing faithfully the measurements of the original pattern layout.

In forming the corner parts of the flexible pattern 5 it is convenient to use thin plates prepared suitably for the corner in order to reproduce the measurements of the original pattern layout. As occasion demands, the flexible pattern may be provided with reinforcement ribs 22, 23. A part 24 illustrates one example of the various possible and desired shapes of castings. By using the flexible pattern 5 of the present invention constructed as above mentioned, the desired shape thereof in accordance with the measurements of the original pattern layout can perfectly be obtained and maintained by supplying, for instance, air under pressure into the interior of the flexible pattern through a hole 7, while the air-tight construction of the flexible pattern is maintained by the protecting flexible cloth 28. When the sand mold has hardened, the over chuck 27 is detached, whereby the protecting flexible bloth 28 is stretched and the bent parts 26–1 and 26–2 are separated from the sand mold. Then, the flexible pattern can easily be withdrawn, in spite of the gradient of the core mold 2 being inverse, without the need of partitioning the sand mold, just as in the case of the casting mold being of a cylindrical form, as the outer part of the flexible pattern made of thin plates and a flexible cloth is separated fromm the sand and moves inwardly therefrom when the inner pressure in the flexible pattern is reduced. If thin plates are lengthy and wide, there is a danger that they will be bent or deformed by an increase in the inner pressure in the flexible pattern. To avoid this danger the thin plates 1 are provided with longitudinal ribs 23 and a lateral ribs 22 of a rigid body so as to maintain the measurements of the original pattern layout.

In case a projection 25 is to be provided in the flexible pattern for indicating numbers of castings, names of manufacturers and samples and the like, it is advisable to enlarge the centripetal monumentum of the thin plates and flexible cloth at the time of removal of the flexible pattern.

As regards sand to be used for forming the sand mold it is convenient to use fluidable sand or compound sand, which can be filled by a vibrator with a small energy near the case of the fluidable sand, because the flexible pattern and ribs can thereby be made light in weight.

In the foregoing there has been explained the method for forming a casting mold according to the present invention. It is noteworthy that, when using the flexible pattern of the present invention, the life of the flexible pattern is lengthened and can be used repeatedly, because the operation of loosening the pattern is not necessary and a friction between the pattern and the sand mold is small. Moreover, as the flexible pattern of the present invention is made light in weight and small in volume, as compared with any conventional patterns, storage of the pattern after the use thereof is convenient.

Particularly, according to the present invention the operating time can largely be shortened, because partitioning and reassembly of the sand mold are not required, so that other common operations such as mold adjustment and inspection of the thickness of castings can be dispensed with. Moreover, there scarcely occurs accidents such as a bleeder or run-out of molten metal from the clamped surfaces, as a natural consequence of the foregoing. Further, the clamping of joints and the luting of the joints after clamped are not required. As regards the quality of products such defects as a mold shift, cast swell and the like can be avoided. Thus, the industrial effects and advantages obtained by the present invention are substantial.

Various modifications are included within the scope of the present invention, as long as they do not deviate from the objects of the present invention, as is evident from the foregoing explanation of the present invention.

EXAMPLE 1

A casting mold of a cylindrical form as shown in FIGS. 1 to 4 (the exterior diameter 200 mm in the upper part and 220 mm in the lower part, the interior diameter 100 mm in the upper part and 120 mm in the lower part and the height 500 mm) was formed according to the following process. Steel plates 1 mm thick were subjected to a sheet metal processing operation to form outer thin plates and an inner thin plate of a pattern in a cylindrical form. The entire outer periphery of this cylindrically formed pattern was covered by a rubber canvas ½ mm thick, with the outer thin plates adhered to the rubber canvas. There were two outer thin plates with intervals of 24 mm each therebetween. The cylindrical pattern was further covered by rubber canvas at its upper and lower ends to form an air-tight construction thereby. A hole 7, through which a plastic bellows-formed hose was inserted, was provided. In this way a flexible pattern was prepared.

The flexible pattern was filled with water through the hole 7, and was then pressed down by a steel plate 10 mm thick, and having a size equal to the cross section of the upper end of the flexible pattern, to prevent the upper end from being swollen and to thereby form the flexible pattern exactly according to the measurements of the original pattern layout or design. During the formation of the flexible pattern no deformation occurred.

Also, when using an air dried sand as another example the predetermined measurements of the original pattern layout were accurately achieved by virtue of the inner pressure.

The flexible pattern, which corresponded exactly to the measurements of the original pattern layout, was placed on a drag previously molded by a self-hardening sand, in which furan resin 2% and phosphoric acid 0.7% were blended. Then, a steel outer mold having an interior diameter of 400 mm, a height of 500 mm and a thickness of 10 mm was placed around the flexible patten, while adjusting respective centers thereof were adjusted to each other, and clamped to the latter. Thereupon, a self-hardening sand of the same composition as the drag was poured around the exterior of the outer cylinder as well as into the interior of the inner cylinder of the flexible pattern, while applying a weak vibration thereto. When the sand of the sand mold has sufficiently hardened in 40 minutes at a room temperature of 28° C that it could be pressed by a finger, the filling fluid was discharged from the hole 7, and the inner pressure in the flexible pattern was reduced to −0.2 atm by means of a vacuum pump, whereby the flexible pattern was easily shrunken or contracted, resulting in forming a gap between the flexible pattern and the interior surface of the sand mold, so that the flexible pattern could easily be withdrawn upwardly, without partitioning and reassembling the sand mold, even though the flexible pattern had an inverse taper of 20/1000. The core mold was connected with the drag by means of an iron core so that they would be united as a unitary body.

The space in the sand mold formed after the removal of the flexible pattern was filled with a graphite mold wash slurry consisting of graphite 34%, isopropyl alcohol 60%, furan resin 4% and phosphoric acid 2%. After 10 seconds the slurry was discharged by turning over the master mold coupled with the drag by means of the supporting rod, whereby a mold was layer having a thickness of about 0.5 mm was formed.

After the mold wash layer has dried and hardened, a previously prepared cope was put on the sand mold, and in this way the formation of the casting mold was completed. By pouring molten cast iron of 1300° C into the casting mold faultless casts could be obtained after cooling.

The mold wash could be applied also by spraying or brushing. In order to quicken the drying of the alcohol content of the mold wash it was also possible to set fire thereto.

EXAMPLE 2

FIGS. 5 to 8 illustrate another example of a flexible pattern forming a rectangular hollow body having a slight direct taper at its outside and an inverse taper at its inside. The flexible pattern was formed by making the outer part therof and a core mold from steel plates 2 mm thick and then covering the exterior surface of the outer part and the interior surface of the core mold with flexible cloth pieces made from plastic reinforced by glass fiber.

When the surface areas of both the long sides and the short sides of the outer part are relatively large, it is necessary to prevent them from being deformed due to the inner pressure by fixing thereto longitudinal ribs and lateral ribs.

A chuck construction subjected to a bending operation for joining opposite edges of the plates of the core mold to each other at the short sides or diagonal corners thereof was prepared. The chuck construction was covered by a flexible cloth, extending over the entire length thereof, to afford a sealing effect thereto at the time of reducing the inner pressure in the pattern.

By reducing the inner pressure within the pattern the flexible pattern could easily be withdrawn from the sand mold, because it separated therefrom. The sand mold was neither deformed nor curved, and an exact mold desired was obtained with a tolerance of ±1 mm. Further, a cope, which was separately prepared, was placed thereon and clamped thereto, whereby the casting mold was completed.

The measurements of a cast obtained by pouring molten iron of 1300° C were exactly like those in Example 1.

The flexible pattern of the present invention was not flawed by friction, and no hindrance to the repeating application thereof was discovered.

I claim:

1. A method for forming a casting mold to be used for the manufacture of hollow metal castings, said method comprising:

forming a tubular, hollow outer flexible pattern member by providing plural plate members arranged generally in the configuration of a predesigned casting outer surface, and wrapping a flexible cloth member around exterior surfaces of said plate members and adhering said cloth member to said exterior surfaces of said plate members, thereby forming a tubular outer flexible pattern member having open opposite ends;

forming a tubular, hollow inner core mold from at least one rigid plate arranged generally in the configuration of a predesigned casting inner surface, thereby forming a tubular core mold having open opposite ends;

placing first ends of said flexible pattern member and said core mold on a mold bottom member, with said core mold within said flexible pattern member, and air-tightly sealing said first ends;

air-tightly sealing second ends of said flexible pattern member and said core mold, to form an enclosed space between said flexible pattern member and said core mold;

supplying fuid into said enclosed space to expand and form said flexible pattern member into precisely the configuration of said predesigned casting outer surface;

placing an outer mold around said flexible pattern member;

supplying mold forming material into a space between said outer mold and said flexible pattern member and into a space within said core mold, and allowing said mold forming material to substantially harden to form a casting mold;

removing said fluid from said enclosed space and allowing said flexible pattern member to contract inwardly from the casting mold; and removing said flexible pattern member and said core mold from the casting mold without separation of said mold bottom member from said casting mold.

2. A method as claimed in claim 1, wherein said fluid is supplied to said enclosed space under pressure.

3. A method as claimed in claim 1, wherein said plate members have intervals laterally therebetween.

4. A method as claimed in claim 1, wherein said core mold is formed of plural plates sealingly adjoined at abutting adjacent edges.

5. A method as claimed in claim 1, wherein said flexible pattern member and said core mold have substantially circular cross-sectional configurations.

6. A method as claimed in claim 1, wherein said flexible pattern member and said core mold have substantially rectangular cross-sectional configurations.

7. A method as claimed in claim 1, wherein said mold forming material comprises sand.

8. A pattern for forming a casting mold to be used for the manufacture of hollow metal castings, said pattern comprising:

a tubular, hollow outer flexible pattern member formed of a plurality of plate members arranged generally in the configuration of a predesigned casting outer surface, and a flexible cloth member wrapped around and adhered to exterior surfaces of said plate members;

a tubular, hollow inner core mold formed of at least one rigid plate arranged generally in the configuration of a predesigned casting inner surface;

said inner core mold being positioned within said flexible pattern member;

means closing opposite adjacent ends of said flexible pattern member and said inner core mold and forming an enclosed space therebetween; and means for supplying a fluid into said enclosed space to expand and form said flexible pattern member into precisely the configuration of said predesigned casting outer surface, said flexible pattern member being capable of inward expansion upon release of said fluid from said enclosed space.

9. A pattern as claimed in claim 8, wherein said fluid supplying means comprises means for supplying fluid under pressure into said enclosed space.

10. A pattern as claimed in claim 8, wherein said plate members have intervals laterally therebetween.

11. A pattern as claimed in claim 8, wherein said inner core mold is formed of plural plates sealingly adjoined at abutting adjacent edges.

12. A pattern as claimed in claim 8, wherein said flexible pattern member and said core mold have substantially circular cross-sectional configurations.

13. A pattern as claimed in claim 8, wherein said flexible pattern member and said core mold have substantially rectangular cross-sectional configurations.

* * * * *